US006393724B1

(12) United States Patent
Apple et al.

(10) Patent No.: US 6,393,724 B1
(45) Date of Patent: May 28, 2002

(54) VEHICLE INTERIOR DRYING APPARATUS

(76) Inventors: Ori Apple, 39 Street Marks Pl., New York, NY (US) 10003; Ehed Cafri, 2600 Netherland Ave., Bronx, NY (US) 10463

( * ) Notice: Subject to any disclaimer, the term of this patent is extended or adjusted under 35 U.S.C. 154(b) by 0 days.

(21) Appl. No.: 09/510,296

(22) Filed: Feb. 22, 2000

(51) Int. Cl.[7] ..... F26B 19/00
(52) U.S. Cl. ..... 34/232; 34/104; 454/119
(58) Field of Search ..... 34/69, 104, 666, 34/443, 444, 232, 215; 454/119, 128

(56) References Cited

U.S. PATENT DOCUMENTS 3,360,954 A * 1/1968 Smider et al.
3,774,262 A 11/1973 Anthony et al.
4,171,580 A * 10/1979 Vabrinskas ..... 34/104
4,771,552 A 9/1988 Morioka
4,979,314 A * 12/1990 Fresnel ..... 34/104
4,991,316 A * 2/1991 Crotts ..... 34/232
5,048,202 A 9/1991 Shero
5,174,048 A 12/1992 Shero
5,187,881 A 2/1993 McElroy
5,797,197 A 8/1998 Alday
5,813,139 A 9/1998 Lillicotch
5,893,216 A * 4/1999 Smith et al. ..... 34/104
6,000,095 A * 12/1999 Johnson ..... 34/666

* cited by examiner

*Primary Examiner*—Gregory Wilson
(74) *Attorney, Agent, or Firm*—Rick Martin; Patent Law Offices of Rick Martin PC

(57) ABSTRACT

The present invention has a heater, a blower and connecting hoses to provide hot air to one or more vent boxes. The vent boxes have multiple, directional hoses to direct hot air to the desired parts of the vehicle. A separate vent box rack is provided to allow the floor mats to be dried at the same time as the rest of the interior.

16 Claims, 3 Drawing Sheets

VEHICLE INTERIOR DRYING APPARATUS

FIELD OF INVENTION

The present invention relates to an apparatus to facilitate the drying of the interior of vehicles and other confined spaces, wherein the apparatus directs hot air specifically on several different surfaces or areas to be dried.

BACKGROUND OF THE INVENTION

It is well known in the art to use hot air to dry any non-temperature sensitive surface after washing or accidental flooding. It is well known to use forced hot air to dry household carpets and the exterior of vehicles. A few of the patents directed to these uses are listed below.

U.S. Pat. No. 4,771,552 to Morioka (1988) discloses a chamber for drying the exterior of an automobile after washing.

U.S. Pat. No. 3,774,262 to Anthony et al. (1973) discloses a portable carpet-cleaning device with water jets and vacuum.

U.S. Pat. No. 5,174,048 to Shero (1992) discloses a portable carpet-drying blower. The blower has one air vent to direct air under a carpet.

U.S. Pat. No. 5,797,197 to Alday (1998) discloses a carpet dryer with a heated air blower and a vacuum to pull water out of the carpet. The device is mounted on wheels to increase portability.

U.S. Pat. No. 5,048,202 to Shero (1991) discloses a portable carpet-drying blower. The blower has one air vent to direct air under a carpet.

U.S. Pat. No. 5,187,881 to McElroy (1993) discloses an automatic dryer for the exterior of a vehicle.

U.S. Pat. No. 5,813,139 to Lillicotch (1998) discloses a blower and holder to dry wall-to-wall carpet.

However, in the process of cleaning vehicles, or similar upholstered and/or carpeted small spaces, the interior often needs cleaning. The interior also must be dried if the vehicle has been flooded. Letting the interior air-dry is not a viable option, particularly in cold and/or humid climates, as it could take days for all the interior surfaces to dry. In addition, long drying times increases the chance of bacterial growth, causing the unpleasant musty smell often associated with wet carpet.

There are many surfaces in a normal vehicle that need drying, including the seats and the front and rear carpets and the floor mats. All of these surfaces are at different levels and separated from each other by barriers. This means that dryers with one hot air vent such as in Lillicotch '139 and Shero '202 and '048 are not very effective for drying the entire interior of a vehicle. The surface that the dryer is placed on will be dried well before the rest of the vehicle is dry. This problem is especially acute for the vehicle detailing industry. The more vehicles that can be done in a day and the faster the vehicle is ready for the client are all major factors in the success of a given car detailing business.

What is needed is a device that will direct hot air to several surfaces and levels at the same time so that the entire interior of the vehicle will be dry at approximately the same time. This system must also be lightweight and relatively easy to move from vehicle to vehicle. Additionally, an apparatus to dry the floor mats at the same time the interior of the vehicle is drying is also needed.

The present invention solves these problems by providing vent boxes with multiple, directional, vent hoses to allow the user to direct hot air to two or more separate areas at the same time. The system is lightweight and easy to place and remove within the vehicle. A rack with several hot air vents is provided to separately dry the floor mats.

SUMMARY OF THE INVENTION

The primary aspect of the present invention is to provide an apparatus to selectively directs hot air to multiple surfaces and levels at the same time.

Another aspect of the present invention is to provide an airbox having s set of flexible vents adapted to dry the front and rear carpets of the passenger compartment of vehicle at the same time.

Another aspect of the present invention is to provide a set of flexible vents to dry the seats and carpet at the same time.

Another aspect of the present invention is to provide a rack around an airbox with vents to dry the floor mats while the rest of the interior is being dried.

Other aspects of this invention will appear from the following description and appended claims, reference being made to the accompanying drawings forming a part of this specification wherein like reference characters designate corresponding parts in the several views.

The present invention has a heater, a blower and connecting hoses to provide hot air to one or more vent boxes. The vent boxes have multiple, directional hoses to direct hot air to the desired parts of the vehicle. A separate vent box is provided to allow the floor mats to be dried at the same time as the rest of the interior.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
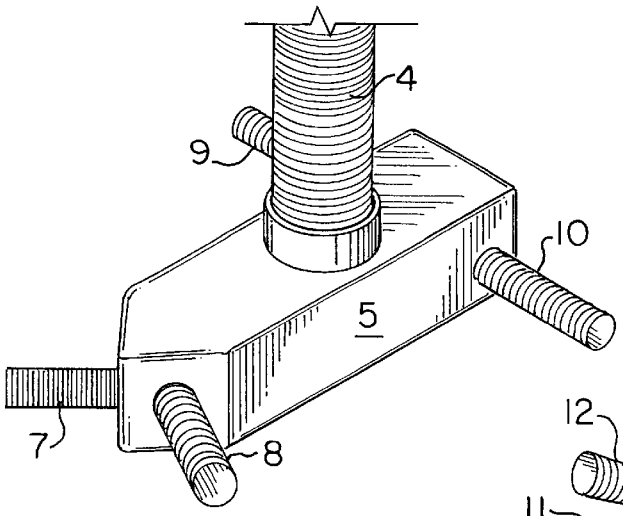
FIG. 1 is a perspective view of the preferred embodiment of a vent box for drying the front and rear carpet at the same time.
Figure 2:
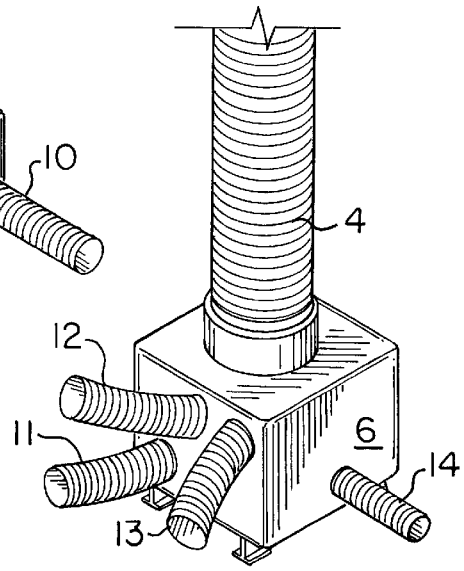
FIG. 2 is a perspective view of the preferred embodiment of a vent box for drying the seats and carpet of the vehicle.
Figure 3:
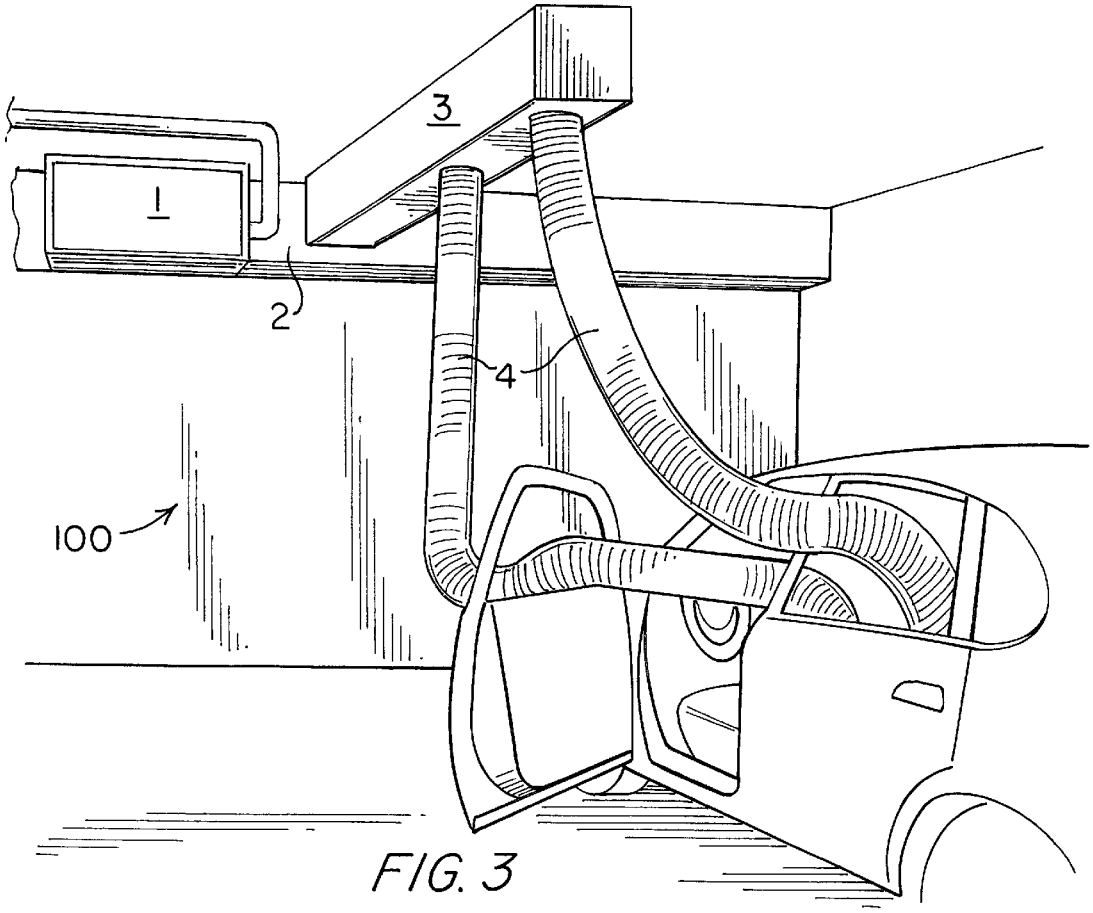
FIG. 3 is a perspective view of the heater, blower and connecting hoses of the preferred embodiment in use.

Referring first to FIGS. 1, 2 and 3, the drying system 100 has a heater 1 with a blower connected to main duct 2. In certain climates and/or applications it is possible to eliminate the heater and only use blown air, not heated air. The main duct 2 is connected to one or more station ducts 103. In the preferred embodiment the ducts 2, 3 are mounted on the ceiling to prevent damage to the ducts and to free up floor space. The station duct 3 is connected to one or more connecting hoses 4. In the preferred embodiment the connecting hoses 4 are 6-inch diameter hoses. The ducts 2, 3, heater 1, blower (not shown), and connecting hoses 4 are well known in the art.

Figure 5:
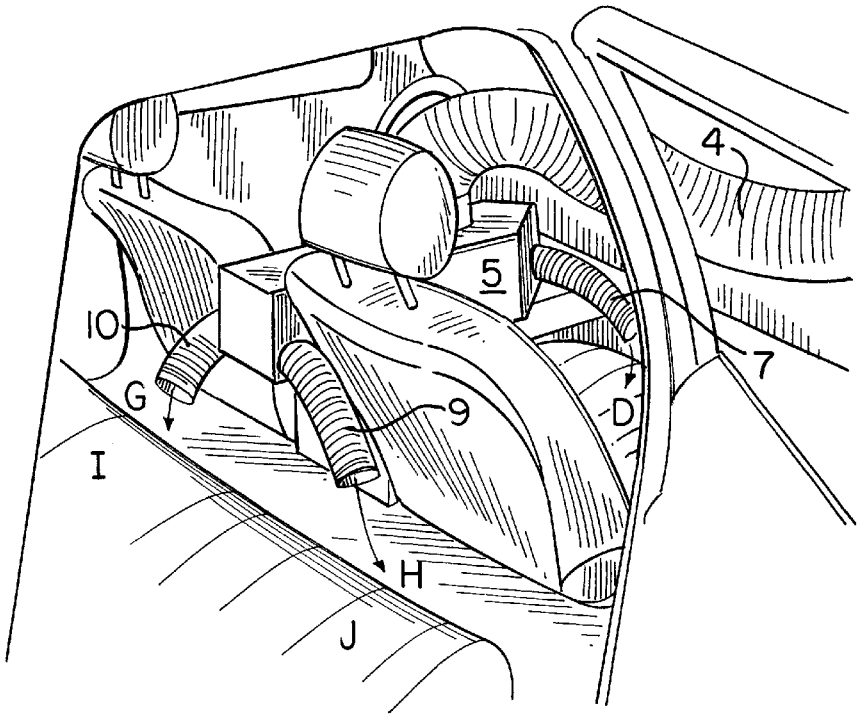
FIG. 5 is a perspective view of the vent box of FIG. 1 in use.

The connecting hose 4 is connected to a vent box, 5, 6. In the preferred embodiment there are two main types of vent boxes. The first type of box is center vent box 5, shown in FIGS. 1 and 5. The center vent box is adapted to direct air either to the front floor areas A, B and rear floor areas G, H or the front seats C, D and rear seats I, J. Center vent box 5 has two sets of directional hoses 7, 8 and 9, 10. The front hoses 7, 8 direct air to either the front seats C, D or the front carpets A, B. The rear hoses 9, 10 directs air to either the rear seats I, J or the rear carpets G, H. The center vent box 5 is generally rectangular in shape and is adapted to fit between the front seats C, D as shown in FIG. 5. The distance between the front seats ranges between 6 inches to two feet or more.

Figure 4:
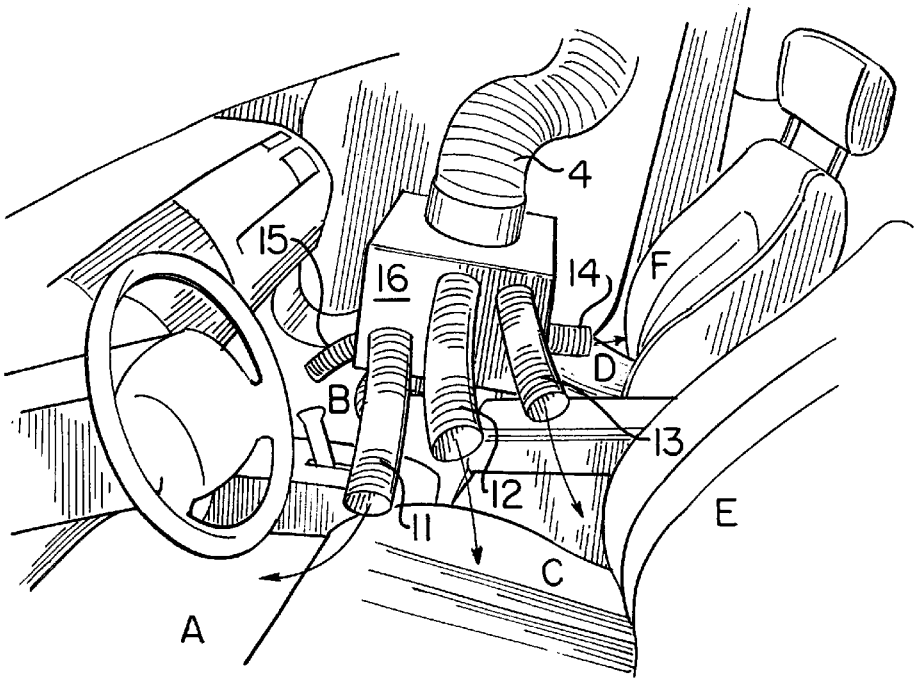
FIG. 4 is a perspective view of the vent box of FIG. 2 in use.
Figure 6:
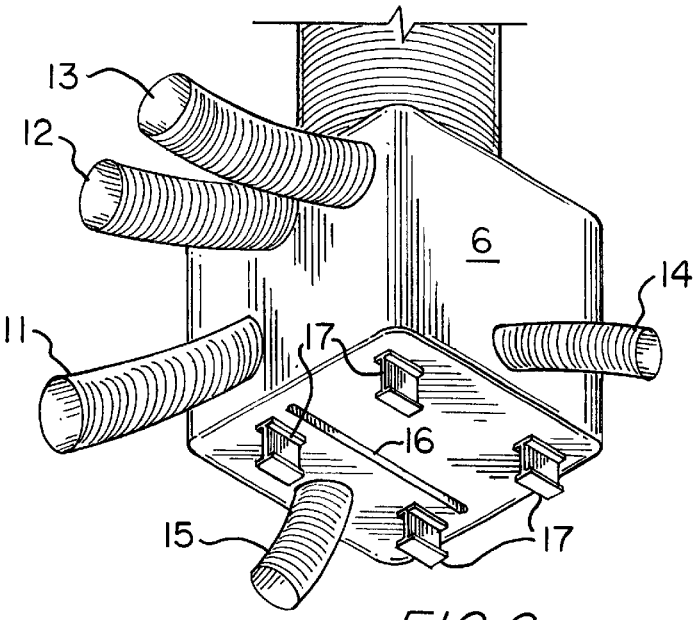
FIG. 6 is a bottom perspective view of the vent box in FIG. 2.

The second type of box is a seat vent box 6, which dries one area at a time, either the front or the rear, as shown in FIGS. 2, 4 and 6. Seat box 6 can be set on either the front passenger seat D or rear passenger seat J. The preferred embodiment is to have seat box 6 designed to sit on the passenger side seats D, J. It is easier to get the seat box 6 in and out of the passenger side without hanging up on the steering wheel.

Seat vent box 6 has five directional hoses 11, 12, 13, 14, and 15. Slot 16, shown in FIG. 6, is provided in the bottom of the seat vent box 6 to dry the seat D that the seat box 6 is sitting on. Feet 17 raise box 6 off the seat D to allow airflow over the seat D. Hose 14 directs air onto the seat back F of the seat D that seat box 6 is sitting on and hose 15 directs air to the floor area B in front of the seat D as shown in FIG. 4.

Hoses 11, 12, and 13 are on one side of box 6 and direct air to the seat and floor area next to the seat the box 6 is sitting on. In the preferred embodiment hoses 11, 12 and 13 direct air to the driver's side. Hose 11 directs air to the floor area A of the driver's side. Hose 12 directs air on to the driver's seat C and hose 13 direct air onto the seat back E as shown in FIG. 4.

The seat vent box 6 only dries the front or rear area, so in most applications two boxes 6 would be used to dry the front and rear area at the same time, as shown in FIG. 3. It is possible to make a seat box 6 that is adapted to sit on the driver's side seats by placing hoses 11, 12, and 13 on the opposite side of the box.

In the preferred embodiment the directional hoses 7, 8, 9, 10, 11, 12, 13, 14, and 15 are made from a stiff hose that can be adjusted somewhat to better direct the air flow in each car, thus the hoses have "memory". The hoses can have wire reinforcement or be made from a stiff plastic with a "memory" that will hold whatever position the hose is placed. The vent boxes 5, 6 are made from any light, heat resistant material. In the preferred embodiment the vent boxes 5, 6 are made from fiberglass.

Figure 7:
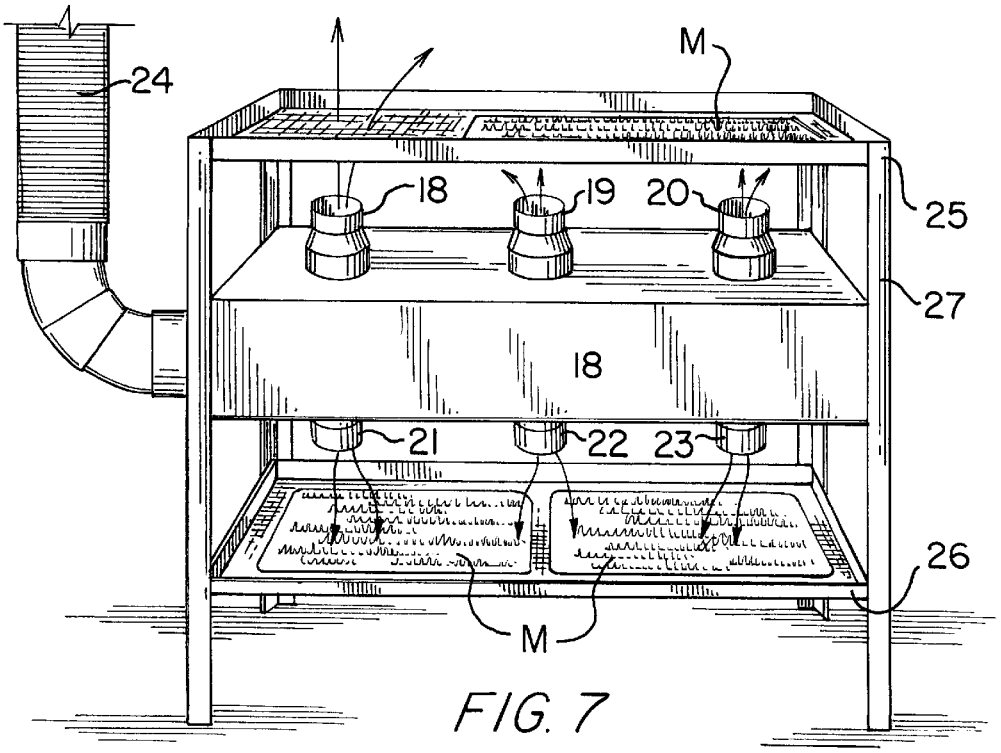
FIG. 7 is a perspective view of a vent box for drying floor mats.

Referring next to FIG. 7, a mat box 18 and frame 27 is provided to allow for drying the floor mats M that are found in many vehicles. These floor mats M are often the dirtiest part of the vehicle and have to be thoroughly washed. It can often take these mats a while to dry on their own. The mat box 18 is connected to the ducts 2,3 with a connector hose 24. Around mat box 18 a frame 27 is provided to lift the mat box 18 off the ground. Several shelves 25, 26 are attached to frame 27 above and below mat box 18. These shelves 25, 26 are made from a mesh on which the mats M sit. Mat box 18 has hoses 18, 19, 20, 21, 22, and 23 which extend from the top and bottom sides of mat box 18, directing air on to the mats M sitting on shelves 25, 26. In the preferred embodiment mat box 18 and frame 27 are made from aluminum. However, any lightweight heat resistant structural material, such as fiberglass, would work.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A vent box for directing airflow comprising:

a container having an air inlet;

one or more directional air hoses forming air outlets:

said hoses comprising a memory material which allows the hose to be bent and then remain in place;

said air inlet further comprising a connector on a top surface of the container;

wherein the container further comprises:

a front surface, an end surface and two opposing side surfaces;

wherein said front surface has one or more directional air hoses extending therefrom; and said opposing side surfaces each have a directional air hose extending therefrom near said end surface.

2. The vent box of claim 1, wherein the container has a width selected to fit between front seats of a vehicle.

3. The vent box of claim 1, wherein the front surface has a triangular cross section.

4. A vent box for directing airflow comprising:

a container having an air inlet;

one or more directional air hoses forming air outlets;

said hoses comprising a memory material which allows the hose to be bent and then remain in place;

said air inlet further comprising a connector on a top surface of the container; and wherein two directional air hoses extend from a front and an end surface of the container.

5. A vent box for directing airflow comprising:

a container having an air inlet;

one or more directional air hoses forming air outlets;

said hoses comprising a memory material which allows the hose to be bent and then remain in place;

said air inlet further comprising a connector on a top surface of the container;

wherein the container further comprises:

a front surface, an end surface, two opposing side surfaces and a bottom surface;

a directional air hose extending from said end surface;

one or more directional air hoses extending from one of the opposing side surfaces; and said bottom surface having a directional air hose extending therefrom and a slot formed in said bottom surface functioning as an air vent.

6. The vent box of claim 5 further comprising a plurality of feet extending from said bottom surface.

7. A vent box for directing airflow comprising:

a container having a front surface, an end surface, two opposing side surfaces and a top and bottom surface;

an air inlet having a connection to a blower for providing a supply of forced air on said front surface;

one or more directional air hoses forming air outlets;

one or more directional air hoses extending from each of said top and bottom surfaces;

a frame attached around said container, said frame including legs; and shelves attached to said frame above and below the container functioning to hold an object to be dried in the airflow from the air hoses, said shelves having perforations for air flow therethrough.

8. A vehicle interior drying system comprising:

a blower;

a heater attached to said blower functioning to heat a flow of air;

a duct attached to said blower;

one or more connecting hoses attached to said duct;

at least one vent box attached to the connecting hose having multiple air vents, adapted to be placed inside a vehicle and direct air to selected parts of the interior of the vehicle.

9. The vehicle interior drying system of claim 8, wherein said air vents each further comprises.a hose with memory.

10. The vehicle interior drying system of claim 9 further comprising; and a mat box attached to said connecting hose, said mat box comprising;

a container having air vents extending from a top surface and a bottom surface;

a frame attached to said container functioning to hold mats to be dried in front of said air vents.

11. The vehicle interior drying system of claim 9, wherein said vent box further comprises:

a front end and a back end;

two hoses extending from each of said front and back ends.

12. The vehicle interior drying system of claim 11, wherein said vent box has a width selected to fit between front seats of a vehicle.

13. The vehicle interior drying system of claim 9, wherein said vent box further comprises:

a front surface, an end surface, two opposing side surfaces and a bottom surface;

a directional air hose extending from said end surface;

one or more hoses extending from one of the opposing side surfaces; and said bottom surface having a directional air hose extending therefrom and a slot formed in said bottom surface functioning as an air vent.

14. The vent box of claim 13 further comprising a plurality of feet extending from said bottom surface.

15. The vehicle interior drying system of claim 8, wherein said duct has a ceiling mount.

16. The vehicle interior drying system of claim 8, wherein said vent box is made of heat resistant material.

* * * * *